US006076980A

United States Patent [19]

Piccinino, Jr. et al.

[11] Patent Number: 6,076,980

[45] Date of Patent: Jun. 20, 2000

[54] PHOTOGRAPHIC PROCESSOR HAVING SCRUBBING ROLLERS

[75] Inventors: Ralph L. Piccinino, Jr., Rush; Kevin H. Blakely; Ross T. Fortunato, both of Rochester, all of N.Y.

[73] Assignee: Eastman Kodak Company, Rochester, N.Y.

[21] Appl. No.: 09/222,503

[22] Filed: Dec. 29, 1998

[51] Int. Cl.[7] ..... G03D 3/08

[52] U.S. Cl. ..... 396/614; 396/617; 396/622; 396/624

[58] Field of Search ..... 396/606, 614, 396/617, 619, 620, 622, 626, 636, 624

[56] References Cited

U.S. PATENT DOCUMENTS

| | | | |
|---|---|---|---|
| 4,081,815 | 3/1978 | Horner | 396/614 |
| 4,125,851 | 11/1978 | Krehbiel . | |
| 4,740,075 | 4/1988 | Schoernig | 396/614 |
| 4,745,423 | 5/1988 | Uchida . | |
| 5,023,644 | 6/1991 | Kurematsu et al. . | |
| 5,047,795 | 9/1991 | Keable et al. . | |
| 5,136,322 | 8/1992 | Ohba et al. . | |
| 5,179,404 | 1/1993 | Bartell et al. . | |
| 5,270,762 | 12/1993 | Rosenburgh et al. . | |
| 5,294,956 | 3/1994 | Earle . | |
| 5,309,191 | 5/1994 | Bartell et al. . | |
| 5,311,235 | 5/1994 | Piccinino, Jr. . | |
| 5,339,131 | 8/1994 | Rosenburgh et al. . | |
| 5,351,104 | 9/1994 | Glover et al. . | |
| 5,353,088 | 10/1994 | Rosenburgh et al. . | |
| 5,381,203 | 1/1995 | Piccinino, Jr. . | |
| 5,387,499 | 2/1995 | Earle et al. . | |
| 5,420,658 | 5/1995 | Manico et al. . | |

FOREIGN PATENT DOCUMENTS

| | | |
|---|---|---|
| 0 559 025 | 9/1993 | European Pat. Off. . |
| 0 559 026 | 9/1993 | European Pat. Off. . |
| 0 559 027 | 9/1993 | European Pat. Off. . |
| 91/12567 | 8/1991 | WIPO . |
| 91/19226 | 12/1991 | WIPO . |
| 92/07301 | 4/1992 | WIPO . |
| 92/07302 | 4/1992 | WIPO . |
| 92/10790 | 9/1992 | WIPO . |
| 92/17370 | 10/1992 | WIPO . |
| 92/17819 | 10/1992 | WIPO . |
| 93/00612 | 1/1993 | WIPO . |
| 93/04404 | 3/1993 | WIPO . |

*Primary Examiner*—Alan A. Mathews
*Attorney, Agent, or Firm*—Frank Pincelli

[57] ABSTRACT

A method and apparatus for processing a photosensitive material. The apparatus includes a narrow processing channel through which a photosensitive material passes. A drive mechanism for transporting of the photosensitive material through the processing channel, and a scrubbing roller which extends across at least a portion of the photosensitive material passing through the processing channel. The scrubbing roller is positioned such that it contacts the photosensitive material passing thereby and is rotated in the opposite direction to the direction of travel of the photosensitive material.

22 Claims, 5 Drawing Sheets

PHOTOGRAPHIC PROCESSOR HAVING SCRUBBING ROLLERS

FIELD OF THE INVENTION

The present invention relates to improvements in or relating to photographic processing apparatus and, more particularly, with respect to photographic processors having narrow processing channels.

BACKGROUND OF THE INVENTION

In order to maintain high quality processing of a photosensitive material in photographic processor, it is important the photosensitive material be maintained in each of the processing solutions it must pass for a predetermined amount of time. It is highly desirable to reduce the amount of time the photosensitive material is present in the processing solutions so as to improve the productivity of the processing apparatus. However, if the photosensitive material is not properly processed, for example washed, the long term stability of the material will be substantially affected. Reducing the time becomes even more difficult in thin tank processors such as described in U.S. Pat. Nos. 5,311,235; 5,309,191; 5,339,131; 5,387,499; 5,353,088; and 5,387,499, 5,420,658; 5,381,203 due to the reduced amount of processing solution that is available.

The present invention provides an improved processor wherein the amount of time required for the photosensitive material in the processing solution is reduced, with out adversely affecting the quality of the processing, and without affecting the photosensitive material.

SUMMARY OF THE INVENTION

The present invention is directed to overcoming one or more of the problems set forth above. Briefly summarized according to one aspect of the present invention there is provided a processor for processing a photosensitive material, the processor comprising:

a narrow processing channel through which a photosensitive material passes;

a drive mechanism for transporting of the photosensitive material through the processing channel; and a scrubbing roller which extends across at least a portion of the photosensitive material passing through the processing channel, the scrubbing roller being positioned such that it contacts the photosensitive material passing thereby and is rotated in the opposite direction to the direction of travel of the photosensitive material.

In accordance with another aspect of the present invention there is provided a method of processing a photosensitive material in a process having a narrow processing channel through which a photosensitive material passes, comprising the steps of:

providing a scrubbing roller which extends across at least a portion of the photosensitive material passing through the processing channel, the scrubbing roller being positioned such that it contacts the photosensitive material passing thereby and is rotated in the opposite direction to the direction of travel of the photosensitive material; and passing a photosensitive material through the processing channel.

The above, and other objects, advantages and novel features of the present invention will become more apparent from the accompanying detailed description thereof when considered in conjunction with the following drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

The present description will be directed in particular to elements forming part of, or in cooperation more directly with, the apparatus in accordance with the present invention. It is understood that elements not specifically shown or described may take various forms well known to those skilled in the art.

Figure 1:
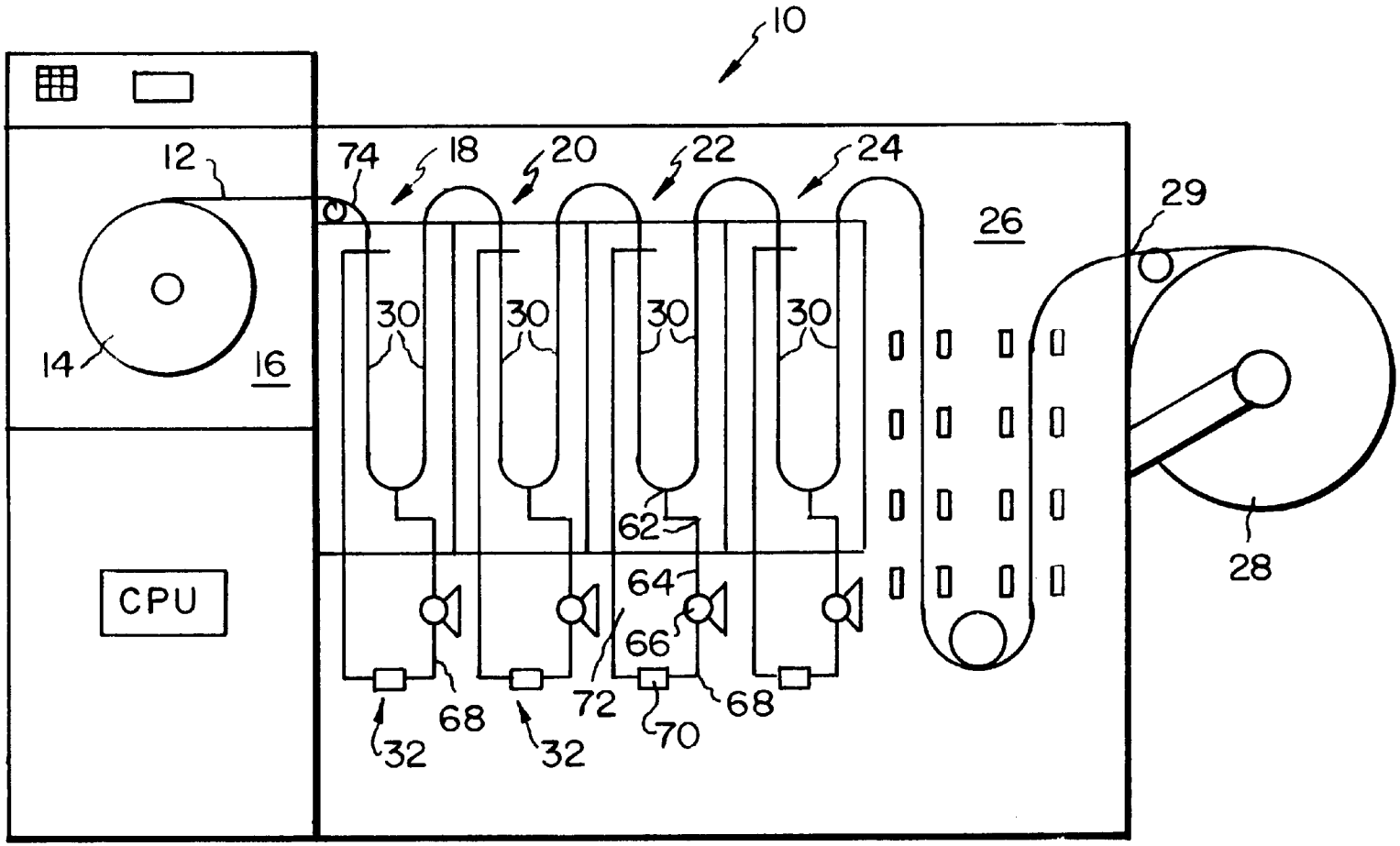
FIG. 1 is a schematic view illustrating a processing apparatus made in accordance with the present invention.

Referring to FIG. 1 there is illustrated a processing apparatus 10 made in accordance with the present invention for processing a photosensitive material 12. In the particular embodiment illustrated, the photosensitive material 12 is supplied on a supply roll 14 that is placed in supply chamber 16. The photosensitive material 12 is fed from the supply roll 14 through a plurality of processing stations 18, 20, 22, 24 wherein the photosensitive material is subjected to different photographic processing solutions. In the particular embodiment illustrated, the processing station 18 is designed for subjecting the photosensitive material 12 to a photographic developing solution; photoprocessing station 20 is designed to subject the photosensitive material 12 to a photographic bleach/fix processing solution; and stations 22 and 24 are designed to subject the photosensitive material 12 to wash/rinse solutions. It is of course understood that any desired number of processing stations may be provided in accordance with the photosensitive material being processed. In the particular embodiment illustrated, the photosensitive material 12 is photographic paper, however, the present invention is not limited to such.

After leaving the station 24, the photosensitive material is passed through a dryer section 26 where it is dried and then passed on out of the apparatus 10 through exit 29 onto a take-up roll 28.

Each of the processing stations 18, 20, 22, 24 are of the low volume thin tank type, that is, a narrow processing channel 30 is provided for containing of the processing solution through which the photosensitive material passes. Additionally, a minimal amount of processing solution is provided in each of the recirculation systems 32 associated with each of the stations.

In the particular embodiment illustrated apparatus 10 is shown as separate device, however, the present invention in not so limited. For example apparatus 10 may be part of a minilab photographic processor.

Figure 2:
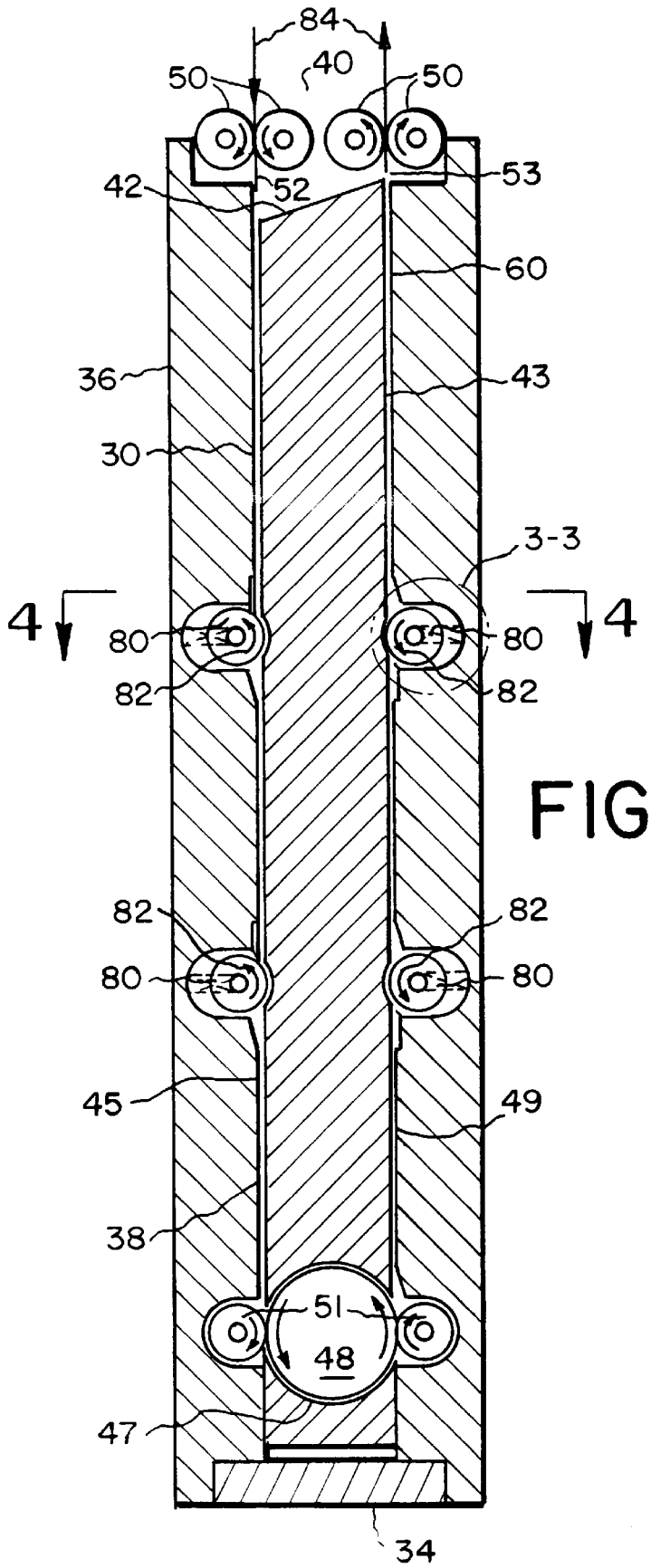
FIG. 2 is a cross-sectional view of one of the processing sections of the apparatus of FIG. 1.

Referring to FIG. 2, there is illustrated in greater detail the rack and tank construction of processing stations 22 and 24. For the sake of clarity of discussion only station 22 will be described in detail, it being understood that station 24 is similarly constructed. It is to be understood that the other processing stations 18 and 20 may be similarly constructed. The processing station 22 includes a processing tank 34 having an exterior wall 36 and a generally U-shaped inner wall 38 which forms chamber 40. Disposed within chamber 40 is a rack 42, which has an exterior wall 43 shaped such that a narrow processing channel 30 is formed between the exterior wall 43 of rack 42 and inner wall 38 of chamber 40. In the embodiment illustrated, channel 30 comprises a first straight section 45, a turn-around section 47, and a second straight section 49, the straight sections 45,49 of channel 30 having a substantially constant thickness T. Attached to the lower end of rack 42 there is provided a turn-around roller 48 which forms turn-around section 47. In the particular embodiment illustrated, upper drive rollers 50 and lower drive rollers 51 are provided for transporting of the photosensitive material 12 through the processor 10. A pair of drive rollers 50 are provided at the entrance 52 and exit 53 of processing channel 30. Lower drive rollers 51 are biased against turnaround roller 48. A photographic processing solution 60 is placed in the processing channel 30 formed between the rack 42 and tank 34. In the embodiment illustrated the station 22 is designed to receive a web of photosensitive material, however, the processing stations may be designed to handle cut sheet or other forms of photosensitive material.

Figure 5:
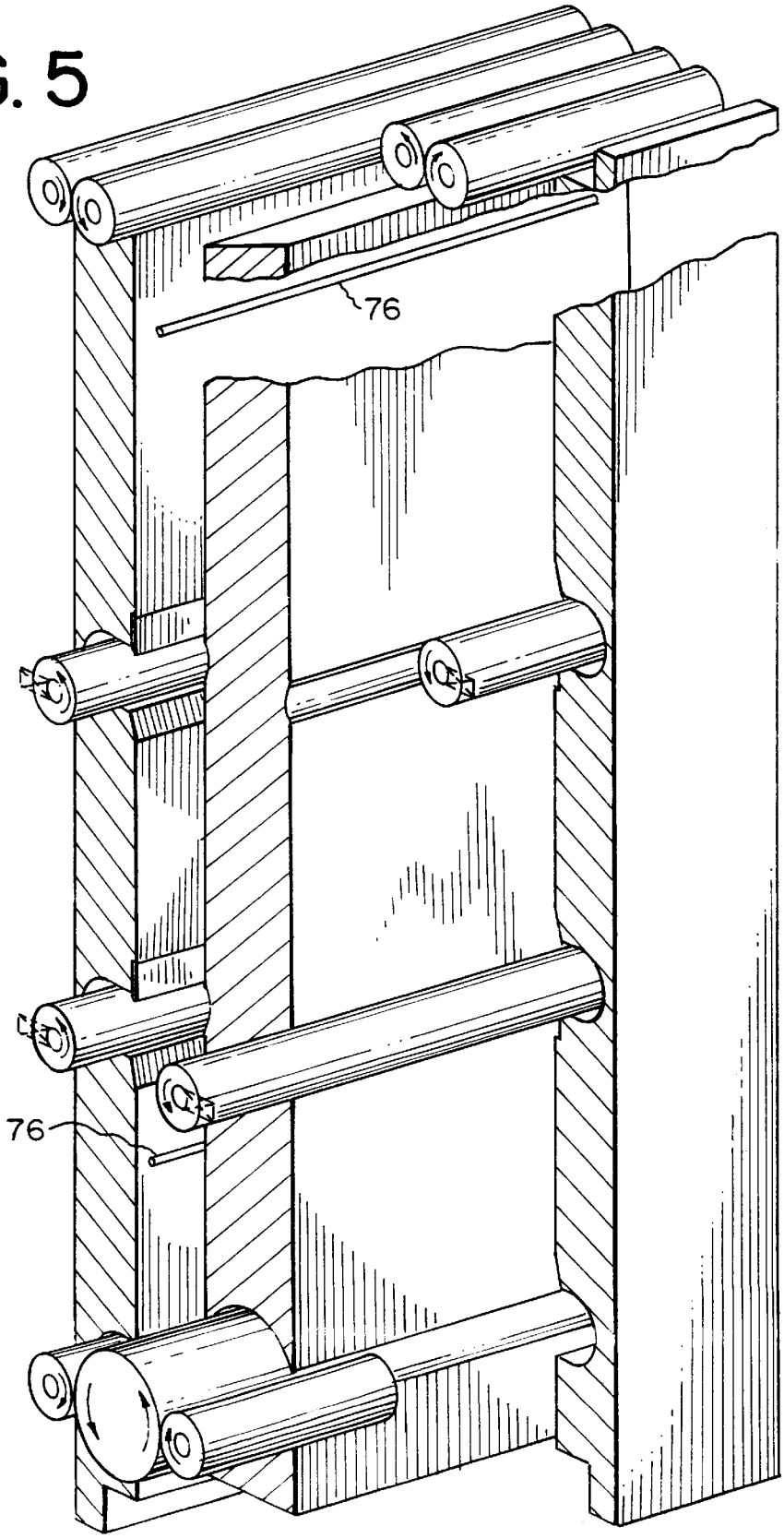
FIG. 5 is perspective view of the processing section of FIG. 2 partially broken-away.

Referring to FIG. 1, the processing solution is recirculated through the processing channel 30 for each of the stations 18, 20, 22, 24. In particular, processing solution is withdrawn from the processing channel 30 through outlet 62 and is directed through an appropriate conduit 64 to recirculation pump 66. The pump 66 circulates the processing solution through conduit 68, filter assembly 70, and then through conduit 72 to inlet 74 provided in rack 42. Each of the inlets 74 is in turn connected to a pair of slot nozzles 76, which extend across the rack (see FIG. 5) for allowing impingement of the processing solution against the photosensitive material 12 passing through straight sections 45,49 of processing channel 30. In order to provide efficient flow of the processing solution through slot nozzles 76, it is desirable that the nozzles deliver the processing solution in accordance with the following relationship:

$$0.6<F/A<23$$

wherein:

F is the flow rate of solution through the nozzle in liters/minute; and

A is a cross-sectional area of the nozzle 76 provided in $cm^2$.

Providing a nozzle in accordance with the foregoing relationship assures a proper impingement discharge of the processing solution against the photosensitive material.

The processing station 22 is of the low volume thin tank type construction. That is, a relatively small mount of processing solution is allowed in the processing channel 30 and the recirculation system 32. This is accomplished by providing a relatively narrow processing channel and by minimizing the amount of processing solution passing through the recirculation system. For the purposes of the present invention a thin processing channel 30 shall be consider a channel wherein the thickness T is equal to or less than about 100 times the thickness of the photosensitive material and preferably equal to or less than about 50 times the thickness of the photosensitive material passing through the apparatus. Most preferably in a processor designed to process photographic paper T is equal to or less than about 10 times the thickness of the photographic paper, and in a processor designed to process photographic film the thickness T is equal to or less than about 18 times the thickness of the photographic film. Also for the purposes of the present invention, a low volume thin tank processor is a processor wherein the ratio of the total volume of processing solution (i.e., processing solution within the processing channel and recirculation system) to the maximum area of the photosensitive material that can be accommodated within the processing channel is less than 35 $dm^3/mm^2$. Preferably, this ratio is less than 11 dm3/mm2, and most preferably, less than about 3 $dm^3/mm^2$. The total volume of the processing solution within the processing channel 30 is preferably such that the volume of the processing solution in the processing channel comprises at about 30% or more out of the total processing solution available in the processing channel 30 and recirculation system 32. Preferably, this ratio it at least 50%. The processor is designed so as not to need any reservoir of processing solution and minimize the amount of processing solution in the entire system. Examples of low volume thin tank processing systems are described and disclosed in the following patent specifications: U.S. Pat. Nos. 5,294,956; 5,179,404; and 5,270,762; EP 559 025; EP 559026; EP 559 027; WO92/10790; WO92/17819; WO93/04404; WO92/17370; WO91/19226; WO91/12567; WO92/07302; WO93/00612; and WO92/07301.

As previously discussed stations 22 and 24 are wash/rinse stations wherein the photosensitive material is washed so as to remove any developer and/or bleach/fix that may be on the photosensitive material as is customarily done in prior art devices. Applicants have provided an improved structure wherein the time necessary for the photosensitive material to be washed is substantially reduced. Referring to FIGS. 2–5 there is illustrated the providing of a plurality of scrubbing rollers 80 disposed in processing channel 30. In the embodiment illustrated four scrubbing rollers 80 are provided, two in section 45 and two in section 49. The scrubbing rollers 80 are designed to contact the photosensitive material 12 and rotate in the opposite direction (as indicated by arrow 82) in which the photosensitive material is moving (as indicated by arrows 84.). It is important that the scrubbing rollers 80 do not interfere with the normal movement of the photosensitive through the processing station 22. Thus, the scrubbing rollers 80 should not apply too great a force against the photosensitive material passing thereby, but yet provides a sufficient amount of contact to wipe the surface of the photosensitive material 12 so as to more efficiently remove undesirable developer and bleach/ fix solution from the surface of the photosensitive material, increase agitation of the washing solution against the photosensitive material 12 in a reduced amount of time and remove any loose particles thereon. An appropriate drive for drive rollers 50 and 51 is such that any force that is applied by the scrubbing rollers 80 can be easily overcome. The scrubbing rollers 80 are mounted to tank 34 so that they move so as to allow the photosensitive to pass thereby yet provide a relatively constant force against the photosensitive material 12. In the embodiment illustrated lateral ends 90, 92 each of the rollers 80 rotatably mounted to tank 34 and are spring biased to move away form the tank 34 toward photosensitive material 12 by a pair of springs 86, 88 located at the lateral ends 90, 92 respectively of the roller 80. Applicants have found that in a processor made in accordance with present invention the time necessary for the photosensitive material to pass through the wash and/or rinse section is reduced from about 90 seconds to less than about 60 seconds, a significant reduction in time.

An appropriate drive, not shown for rotating rollers 80 in the desired direction is provided. For example, but not by way of limitation a drive motor may be connected to rollers by an appropriate transmission. Each of the rollers is provided with a contact section 94 for contacting the surface 95 of the photosensitive material 12. Preferably the rotational speed of the rollers 80 is greater than the lineal speed of the photosensitive material 12 going through the station 22. In the embodiment illustrated the speed of the rollers 80 at the surface of the photosensitive material 12 is about twice that of the speed of the photosensitive material 12.

The contact section 94 preferably has a length W which is equal to or greater than the width W1 of the photosensitive material 12. The contact section 94 is made of a material that will not adversely affect the photosensitive material 12. Examples of suitable material for contact surface 94 are silicone, EPDM closed/opened cell foam, mohair and various plastics. In the particular embodiment illustrated surface 94 is made of a silicone having a durometer hardness of about 30.

Figure 3:
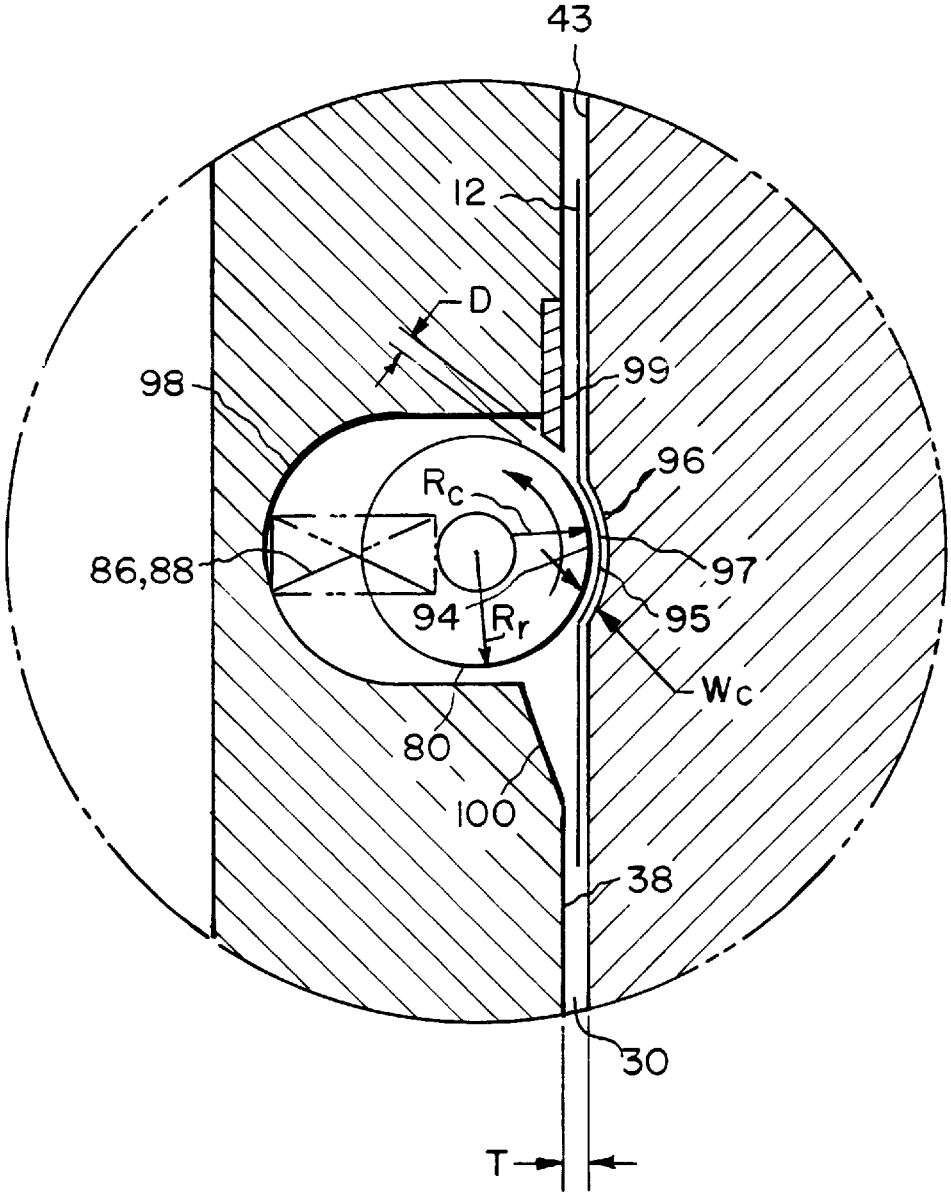
FIG. 3 is an enlarged view of a portion of the section of FIG. 2 as shown by line 3—3.
Figure 4:
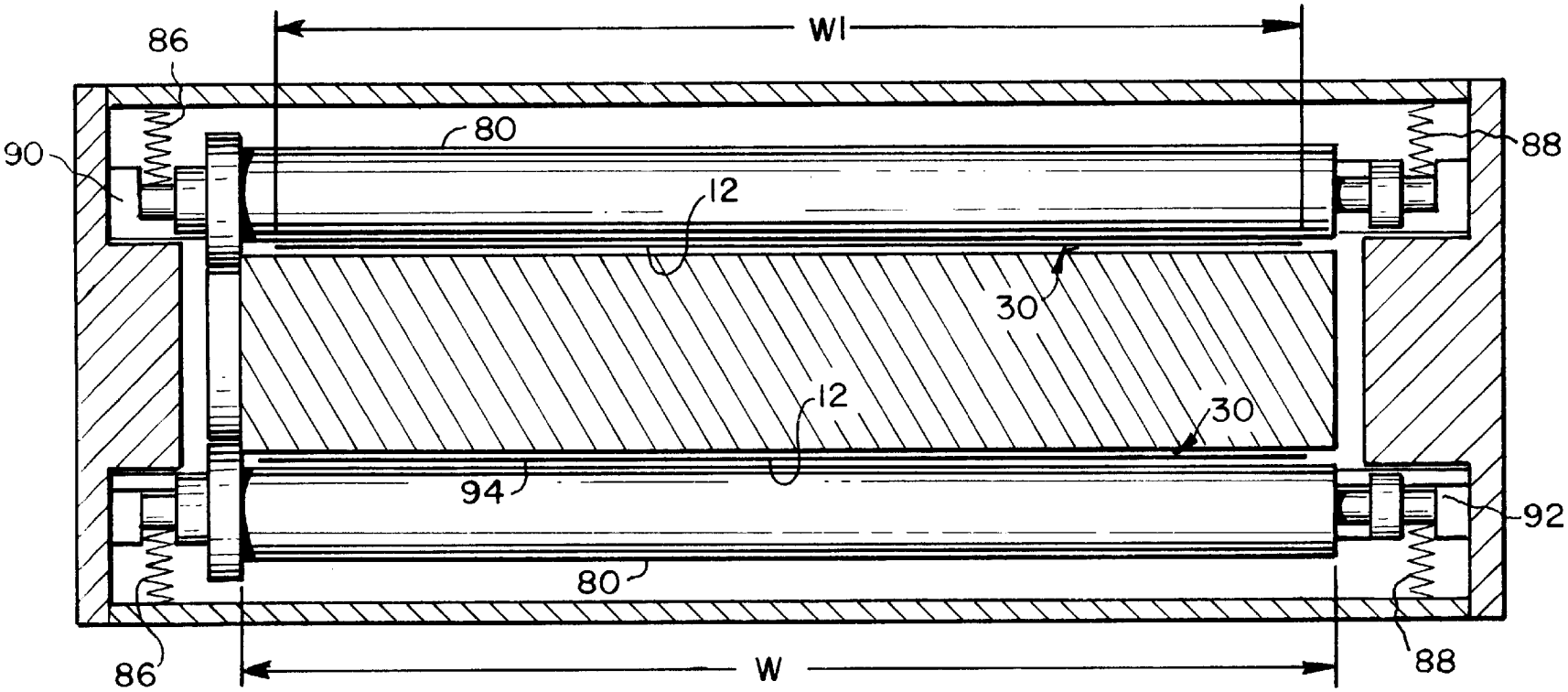
FIG. 4 is a cross-sectional view of the processing section of FIG. 2 as taken along line 4—4.

Referring to FIG. 3, there is illustrated an enlarged cross-section view of the processing channel 30 adjacent the one of the rollers 80. The inner wall 38 disposed opposite the roller 80 is preferably shaped such that minimal or no contact occurs between the photosensitive material 12 and the inner wall 38 so as to not unduly restrict movement of the photosensitive material or damage the photosensitive material 12. In particular there provided a recess section 96 which has a shape that substantially corresponds to the shape of adjacent roller 80 and sized so that a space 97 having width Wc which is greater than the thickness of the photosensitive material 12. Preferably, as illustrated, recess section 96 has a radius Rc which is equal to or greater than the radius Rr of roller 80. Also as illustrated in FIG. 3 a recess 98 is provided behind roller 80 for allowing roller 80 to move toward and away from photosensitive material 12. The rollers 80 are mounted such that it is restricted in the total amount of movement by springs 86, 88 to a predetermined amount so that the photosensitive material 12 will not be pinched off in recess 96 thus minimizing any potential damage to the photosensitive material.

In order to minimize the possibility of the leading edge of the photosensitive material 12 from jamming in to rollers 80, a guide 99 is provide upstream of each roller 80 so as to minimize the distance D between the roller and guide 99. The distance D may vary depending upon the physical characteristics of the photosensitive material 12 being passed through the processor 10. In the embodiment illustrated D is about 1 mm.

The processing channel 30 adjacent the exit side of the roller 80 is preferably provided with a beveled section 100 so that the leading edge of the photosensitive material 12 will not jam within channel 30. The particular angle and size of beveled section 100 will again vary depending upon the particular physical characteristics of the photosensitive material 12.

In the preferred embodiment illustrated the rollers 80 are mounted to a first section (the tank 34) and the recess 96 is provided in a second section (the rack). However, the present invention is not so limited as the recess and rollers may be mounted in alternate first and second sections as desires.

The invention has been described in detail with particular reference to certain preferred embodiments thereof, but it will be understood that variations and modifications can be effected within the spirit and scope of the invention.

What is claimed is:

1. A processor for processing a flexible photosensitive material, said processor comprising:

a narrow processing channel through which a photosensitive material passes;

a drive mechanism for transporting of the photosensitive material through said processing channel; and a scrubbing roller which is positioned within said narrow processing channel and extends across at least a portion of the photosensitive material passing through the processing channel, said scrubbing roller being positioned such that it contacts the photosensitive material passing thereby and is rotated in the opposite direction to the direction of travel of the photosensitive material.

2. An apparatus according to claim 1 wherein said scrubbing roller is mounted such that a predetermined maximum amount of force will be applied said roller against the photosensitive material passing thereby.

3. An apparatus according to claim 1 wherein the channel is formed by first and second sections, said scrubbing roller being associated with said first section, said second section having a recess section positioned opposite said scrubbing roller having a configuration substantially conforming outer shape of said scrubbing roller.

4. An apparatus according to claim 1 wherein the channel is formed by first and second sections, said scrubbing roller being spring mounted to said first section toward the photosensitive material.

5. An apparatus according to claim 1 wherein the channel is formed by first and second sections, said first section having a recess for receiving said scrubbing roller.

6. An apparatus according to claim 5 wherein the said recess for receiving said scrubbing roller, said recess having a shape which is slightly larger than said scrubbing roller.

7. An apparatus according to claim 1 wherein said scrubbing roller is made out of a material having silicone.

8. An apparatus according to claim 1 wherein a plurality of scrubbing rollers are provided.

9. An apparatus according to claim 1 wherein a drive roller is provided for transporting of the photosensitive material through the narrow processing channel.

10. An apparatus according to claim 1 further comprising at least one nozzle for introducing a processing solution into processing channel and directed at said photosensitive material.

11. An apparatus according to claim 1 wherein said apparatus is of the low volume type processor.

12. An apparatus according to claim 1 wherein a guide is provided adjacent to said scrubbing roller and upstream of delivery of the photosensitive material to said scrubbing roller.

13. An apparatus according to claim 1 wherein said channel adjacent to said scrubbing roller and down stream of delivery of the photosensitive material is provided with a beveled section.

14. An apparatus according to claim 1 wherein the thickness of the processing channel is equal to or less than about fifty times the thickness of the photosensitive material.

15. An apparatus according to claim 1 wherein the thickness of the processing channel is equal to or less than about eighteen times the thickness of the photosensitive material.

16. An apparatus according to claim 1 wherein the thickness of the processing channel is equal to or less than about ten times the thickness of the photosensitive material.

17. An apparatus according to claim 1 wherein said scrubbing roller is spring mounted to said apparatus.

18. An apparatus according to claim to 1 wherein said roller are mounted such that it is restricted in the total amount of movement a predetermined amount so that the photosensitive material will not be pinched off by said roller.

19. A method of processing a flexible photosensitive material in a process having a narrow processing channel through which a photosensitive material passes, comprising the steps of:

providing a scrubbing roller which is positioned within said narrow processing channel and extends across at least a portion of the photosensitive material passing through the processing channel, said scrubbing roller being positioned such that it contacts the photosensitive material passing thereby and is rotated in the opposite direction to the direction of travel of the photosensitive material; and passing a photosensitive material through said processing channel.

20. A method according to claim 19 further comprising the step of introducing an impinging processing solution into said processing channel against photosensitive material.

21. A processor for processing a flexible photosensitive material, said processor comprising:

a narrow processing channel through which a photosensitive material passes;

a drive mechanism for transporting of the photosensitive material through said processing channel; and a scrubbing roller which is positioned within said narrow processing channel and extends across at least a portion of the photosensitive material passing through the processing channel, said scrubbing roller being spring mounted to said processor such that it contacts the photosensitive material passing thereby and is rotated in the opposite direction to the direction of travel of the photosensitive material.

22. An apparatus according to claim 21 wherein said scrubbing roller is being rotated at a speed greater than the speed at which the photosensitive material is moving.

* * * * *